United States Patent [19]

Iizuka

[11] 4,316,438

[45] * Feb. 23, 1982

[54] INTERNAL COMBUSTION ENGINE

[75] Inventor: Haruhiko Iizuka, Yokosuka, Japan

[73] Assignee: Nissan Motor Company, Limited, Yokohama, Japan

[ * ] Notice: The portion of the term of this patent subsequent to May 6, 1997, has been disclaimed.

[21] Appl. No.: 43,104

[22] Filed: May 29, 1979

[30] Foreign Application Priority Data

Jan. 31, 1979 [JP] Japan ..... 54-9887

[51] Int. Cl.[3] ..... F02D 17/00

[52] U.S. Cl. ..... 123/198 F; 123/568

[58] Field of Search ..... 123/198 F, 568, 478

[56] References Cited

U.S. PATENT DOCUMENTS

| | | | |
|---|---|---|---|
| 2,875,742 | 3/1939 | Dolza | 123/568 |
| 2,919,686 | 1/1960 | Mick | 123/198 F |
| 3,756,205 | 9/1973 | Frost | 123/481 |
| 3,765,394 | 10/1973 | Francis | 123/198 F |
| 3,779,013 | 12/1973 | Faber et al. | 123/568 |
| 4,143,635 | 3/1979 | Iizuka et al. | 123/198 F |
| 4,192,278 | 3/1980 | Iizuka et al. | 123/198 F |
| 4,194,475 | 3/1980 | Saiki | 123/568 |
| 4,198,940 | 4/1980 | Ishida | 123/198 F |
| 4,201,180 | 5/1980 | Iizuka | 123/568 |
| 4,204,514 | 5/1980 | Ishida | 123/198 F |

FOREIGN PATENT DOCUMENTS

| | | |
|---|---|---|
| 0616204 | 7/1935 | Fed. Rep. of Germany . |
| 2353908 | 5/1974 | Fed. Rep. of Germany . |
| 2628091 | 1/1977 | Fed. Rep. of Germany . |
| 0828235 | 2/1960 | United Kingdom . |
| 1528515 | 10/1978 | United Kingdom . |

OTHER PUBLICATIONS

"Commutation de 6 à 3 cylindres", *Revue Automobile,* No. 48, (Nov. 23, 1978), Berne, Switzerland.

*Primary Examiner*—P. S. Lall

*Attorney, Agent, or Firm*—Schwartz, Jeffery, Schwaab, Mack, Blumenthal & Koch

[57] ABSTRACT

An internal combustion engine is disclosed which includes a plurality of cylinders split into first and second groups, the first group of cylinders operative regardless of engine load conditions and the second group of cylinders inoperative when the engine is under low load conditions. The engine comprises an air intake passage having therein a throttle valve, first valve means provided in the air intake passage to form an intake chamber communicating with the second group of cylinders and isolated from the first group of cylinders when closed, an exhaust passage divided at its upstream portion to form first and second exhaust passages for passing therethrough the exhaust gases discharged from the first and second groups of cylinders, respectively, an exhaust gas recirculation passage connected at its outlet end to the intake chamber and at its inlet end to the second exhaust passage, second valve means provided in the recirculation passage for opening and closing the same, and control means responsive to engine load conditions for closing the first valve means to prohibit air flow to the second group of cylinders and opening the second valve means to allow recirculation of a portion of the exhaust gases discharged from the second group of cylinders when the engine is under low load conditions.

3 Claims, 4 Drawing Figures

INTERNAL COMBUSTION ENGINE

BACKGROUND OF THE INVENTION

1. Field of the Invention

This invention relates to an internal combustion engine and, more particularly, to an internal combustion engine including a plurality of cylinders split into first and second groups, the first group of cylinders held operative independently of engine load conditions and the second group of cylinders held inoperative when the engine is under low load conditions.

2. Description of the Prior Art

Generally, there is a tendency of an internal combustion engine such that it consumes a larger amount of fuel under a lower load condition. Thus, the need has been recognized for a new and improved internal combustion engine which can operate with less fuel consumption over a wide range of engine load conditions.

SUMMARY OF THE INVENTION

It is therefore one object of the present invention to provide an improved internal combustion engine having high fuel economy.

Another object of the present invention to provide an internal combustion engine exhibiting superior performance over a wide range of conditions.

These and other objects are accomplished, in accordance with the present invention, by an internal combustion engine comprising a plurality of cylinders split into first and second groups, an air intake passage having therein a throttle valve and divided at its portion downstream of the throttle valve to form first and second intake passages isolated from each other for passing therethrough air to the first and second groups of cylinders, respectively, first valve means provided in the second intake passage for opening and closing the same, an exhaust passage divided at its upstream portion to form first and second exhaust passages for passing therethrough the exhaust gases discharged from the first and second groups of cylinders, respectively, an exhaust gas recirculation passage connected at its outlet end to the second intake passage, second valve means provided in the recirculation passage for opening and closing the same, and control means responsive to engine load conditions for closing the first valve means to prohibit air flow to the second group of cylinders and opening the second valve means to allow recirculation of a portion of the exhaust gases discharged from the second group of cylinders when the engine is under low load conditions.

Other objects, means, and advantages of the present invention will become apparent to one skilled in the art thereof from the following description.

BRIEF DESCRIPTION OF THE DRAWINGS

The following explanation of several preferred embodiments of the present invention will help in the understanding thereof, when taken in conjunction with the accompanying drawings, which, however, should not be taken as limiting the present invention in any way, but which are given for purposes of illustration only. In the drawings, like parts are denoted by like reference numerals in the several figures, and.

DESCRIPTION OF THE PREFERRED EMBODIMENTS

Figure 1:
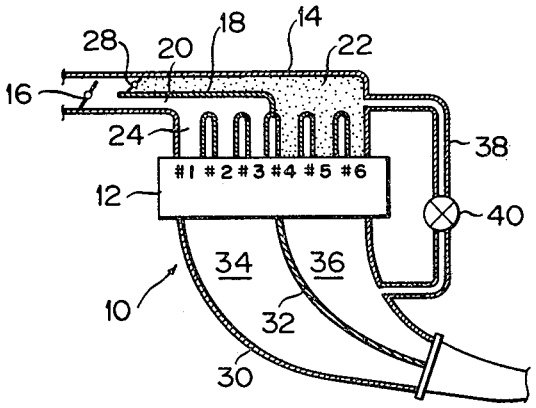
FIG. 1 is a schematic sectional view illustrating one embodiment of the internal combustion engine of the present invention.

Referring now to FIG. 1, there is schematically shown a first embodiment of the present invention. An internal combustion engine is generally designated at 10 which comprises a cylinder block 12 having therein a first group of cylinders #1 to #3 and a second group of cylinders #4 to #6. An air intake passage 14 has therein a throttle valve 16 and is divided at its portion downstream of the throttle valve 16 by a dividing wall 18 to form first and second intake passages 20 and 22. The first intake passage 20 passes fresh air from the air intake passage 14 through a first intake manifold 24 to the first group of cylinders #1 to #3 and the second intake passage 20 passes fresh air from the air intake passage 14 through a second intake manifold 26 to the second group of cylinders #4 to #6. An air admission valve 28 is provided in the second intake passage 22 for prohibiting air flow to the second group of cylinders #4 to #6 when closed.

When the engine is running under low load conditions, it operates in a partial-cylinder mode of operation wherein the throttle valve 16 is open and the air admission valve 28 is closed so that the first group of cylinders #1 to #3 are supplied with fresh air and held in operation whereas the second group of cylinders #4 to #6 are supplied with no fresh air and held out of operation. On the other hand, when the engine is running under the other load conditions, it operates in a full-cylinder mode of operation wherein the throttle valve 16 is open and the air admission valve 28 is open so that both the first and second groups of cylinders #1 to #6 are supplied with fresh air and held in operation.

The engine also comprises an exhaust passage 30 divided at its upsream portion by a partition 32 to form first and second exhaust passages 34 and 36. The first exhaust passage 34 passes the exhaust gases discharged from the first group of cylinders #1 to #3 and the second exhaust passage 36 passes the exhaust gases discharged from the second group of cylinders #4 to #6. An exhaust gas recirculation passage 38 is provided which is connected at its inlet end to the second exhaust passage 36 and at its outlet end to the second intake passage 20 so as to bypass the second group of cylinders #4 to #6. The EGR passage 38 has therein an EGR vavle 40 which is open to allow recirculation of exhaust gases from the second exhaust passage 36 to the second intake passage 20 when the engine is under low load conditions. This reduces the difference between the pressures in the second intake and exhaust passages 20 and 36 so as to reduce the pumping loss of the suspended cylinders #4 to #6. The exhaust gases recirculated through the EGR passage 38 are substantially isolated from the exhaust gases discharged from the first group of cylinders. This makes it possible to maintain elevated the temperature of the exhaust gases which is to be introduced into a catalyzer (not shown) provided at a location downstream of the first and second exhaust passages 34 and 36 with the result that the exhaust has a minimal level of air pollutants.

If the second intake passage 22 has a large volume and a great amount of exhaust gases is recirculated through the EGR passage 38 and permeated in the second intake passage 22, a portion of the exhaust gases would flow through the valve 28 into the first group of cylinders #1 to #3 to cause misfire therein and also an excessive amount of the exhaust gases would flow into the second group of cylinders #4 to #6 to cause misfire therein when the engine is shifted from a partial-cylinder mode into a full-cylinder mode.

Figure 2:
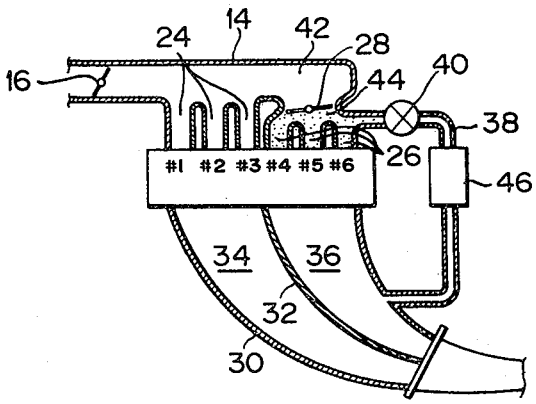
FIG. 2 is a schematic sectional view illustrating a second embodiment of the present invention.

Referring to FIG. 2, there is illustrated an alternative embodiment of the present invention which can eliminate the possibility of occurrence of misfire. The chief difference between FIG. 2 and the first described embodiment is that the dividing wall 18 is removed and instead the air admission valve 28 is located in the air intake passage 14 such that it divides the air intake passage 14 into a common intake chamber 42 and a small intake chamber 44 communicating with the second intake manifold 26 and isolated from the first intake manifold 24 when closed. The outlet end of the EGR passage 38 is connected to the intake chamber 44. Preferably, the EGR passage 38 is provided at a location downstream of the EGR valve 40 with an increased diameter portion to form a collection chamber 46 which serves to buffer the flow of the recirculated exhaust gases so as to provide for increased exhaust gas suction efficiency.

Figure 3A:
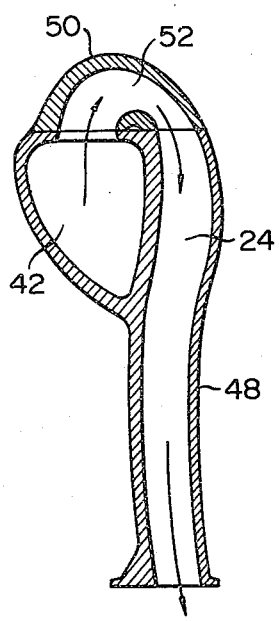
FIG. 3A is an enlarged sectional view showing the air intake system for passing air to the first group of cylinders.
Figure 3B:
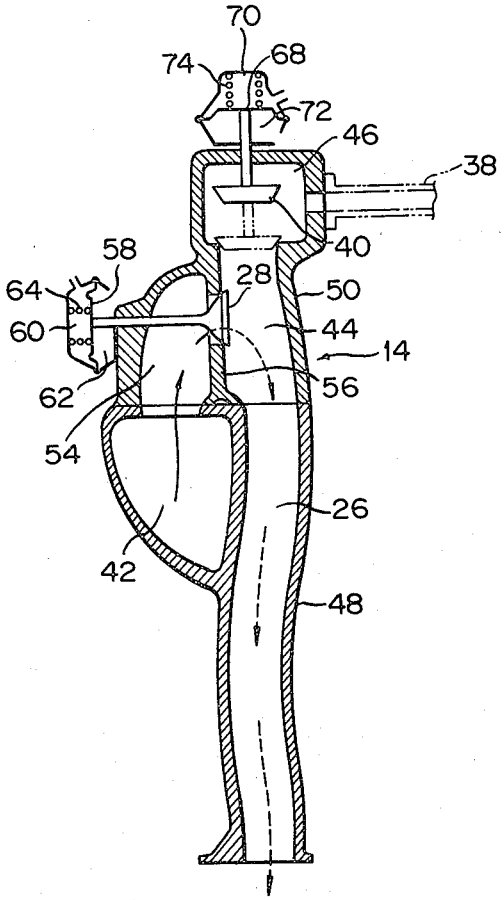
FIG. 3B is an enlarged sectional view showing the air intake system for passing air to the second group of cylinders.

Referring to FIGS. 3A and 3B, the detail of the air intake arrangement is shown. FIG. 3A is an enlarged sectional view showing the air intake arrangement on the part of the first group of cylinders #1 to #3 and FIG. 3B is an enlarged sectional view showing the air intake arrangement on the part of the second group of cylinders #4 to #6. The air intake arrangement is made up of two blocks 48 and 50 connected in place to each other. The block 48 has therein the common intake chamber 42, the first intake manifold 24 (FIG. 3A), and the second intake manifold 26 (FIG. 3B). The block 50 has therein a connection chamber 52 communicating the common intake chamber 42 with the first intake manifold 24 as shown in FIG. 3A and also has therein the collection chamber 46, the intake chamber 44, and a connection chamber 54 communicating the common intake chamber 42 with the intake chamber 44 as shown in FIG. 3B. The air admission valve 28 is provided in a dividing wall 56 between the connection chamber 54 and the intake chamber 42. The EGR valve 40 is provided over the opening communicating the collector chamber 46 with the intake chamber 44.

The air admission valve 28 is drivingly connected to a diaphragm 58 spreaded within a casing to divide it into first and second chambers 60 and 62. The first chamber 60 is connected to a suitable negative pressure source and the second chamber 62 is open to the atmosphere. A spring 64 is provided within the first chamber 60 for urging the diaphragm 58 toward the second chamber 62 so as to open the air admission valve 28. When a negative pressure is charged into the first chamber 60, the diaphragm 58 moves toward the first chamber 60 against the force of the spring 64 so as to close the air admission valve 28.

Similarly, the EGR valve 40 is drivingly connected to a diaphragm 68 spreaded within a casing to divide it into first and second chambers 70 and 72. The first chamber 70 is connected to a suitable negative pressure source and the second chamber 72 is open to the atmosphere. A spring 74 is provided within the first chamber 70 for urging the diaphragm 68 toward the second chamber 72 so as to close the EGR valve 40. A negative pressure introduced into the first chamber 70 causes movement of the diaphragm 68 toward the first chamber 70 against the force of the spring 74 so as to open the EGR valve 40.

In operation, when the engine is under high load conditions, the throttle valve 16 is open, the air admission valve 28 is open, and the EGR valve 40 is closed so that the fresh air drawn through the air intake passage 14 into the common intake chamber 42 is fed through the first intake manifold 24 into the first group of cylinders #1 to #3 and also through the intake chamber 44 and the second intake manifold 26 into the second group of cylinders #4 to #6. Also, fuel is supplied into all of the cylinders #1 to #6 from a suitable fuel supply system (not shown). Thus, the engine runs in a full-cylinder mode of operation where both the first and second groups of cylinders are operative.

When the engine is under low load conditions, the air admission valve 28 is closed to prohibit air flow to the second group of cylinders #4 to #6 and the EGR valve 40 is open to allow recirculation of the exhaust gases discharged from the second group of cylinders #4 to #6 into the intake chamber 44 through the EGR passage 38. Also, the supply of fuel into the second group of cylinder mode of operation where the first group of cylinders are in operation whereas the second group of cylinders are out of operation.

When the engine is shifted from a partial-cylinder mode into a full-cylinder mode and the air admission valve 28 is open and the EGR valve 40 is closed, fresh air is drawn through the common intake chamber 42 and the connection chamber 54 into the intake chamber 44 and hence through the second intake manifold 26 into the second group of cylinders #4 to #6 and substantially no amount of the exhaust gases premeated in the intake chamber 44 and the second intake manifold 26 flows through the common intake chamber 42 into the first group of cylinders #1 to #3.

Since the air admission valve 28 is disposed near the diverged portion of the second intake manifold 26 so as to define a small-volume intake chamber 44, there is no possibility of the exhaust gases recirculated and stored therein flowing into the first group of cylinders #1 to #3 and causing misfire therein when the air admission valve 28 is open.

While the present invention has been shown and described with reference to some preferred embodiments thereof, and with reference to the drawings, it should be understood that various changes and modifications may be made to the form and the detail thereof, by one skilled in the art, without departing from the scope of the present invention. Therefore, it should be understood by all those whom it may concern that the shown embodiments, and the drawings, have been given for the purpose of illustration only, and are not intended to limit the scope of the present invention, or of the protection sought to be granted by Letters Patent, which are solely to be defined by the accompanying Claims.

What is claimed is:

1. An internal combustion engine comprising a plurality of cylinders split into first and second groups, an air intake passage having therein a throttle valve and divided at its portion downstream of said throttle valve to form first and second intake passages isolated from each other for passing therethrough air to said first and second groups of cylinders, respectively, first valve means provided in said second intake passage for opening and closing the same, an exhaust passage divided at its upstream portion to form first and second exhaust passages for passing therethrough the exhaust gases discharged from said first and second groups of cylinders, respectively, an exhaust gas recirculation passage connected at its inlet end to said second exhaust passage and at its outlet end to said second intake passage, second valve means provided in said recirculation passage for opening and closing the same, and control means responsive to engine load conditions for closing said first valve means to prohibit air flow to said second group of cylinders and opening said second valve means to allow recirculation of a portion of the exhaust gases discharged from said second group of cylinders when said engine is under low load conditions.

2. An internal combustion engine comprising a plurality of cylinders split into first and second groups, an air intake passage having therein a throttle valve, a first valve means provided in said air intake passage to form an intake chamber communicating with said second group of cylinders and isolated from said first group of cylinders when closed, an exhaust passage divided at its upstream portion to form first and second exhaust passages for passing therethrough the exhaust gases discharged from said first and second groups of cylinders, respectively, an exhaust gas recirculation passage connected at its outlet end to said intake chamber and at its inlet end to said second exhaust passage, second valve means provided in said recirculation passage for opening and closing the same, and control means responsive to engine load conditions for closing said first valve means to prohibit air flow to said second group of cylinders and opening said second valve means to allow recirculation of a portion of the exhaust gases discharged from said second group of cylinders when said engine is under low load conditions.

3. An internal combustion engine according to claim 2, wherein said recirculation passage has its diameter increased at its portion upstream of said second valve means to form a collection chamber.

* * * * *